US008936346B2

(12) United States Patent
Kawakami et al.

(10) Patent No.: US 8,936,346 B2
(45) Date of Patent: Jan. 20, 2015

(54) LIQUID REMOVING DEVICE AND LIQUID EJECTING APPARATUS

(71) Applicant: Seiko Epson Corporation, Tokyo (JP)

(72) Inventors: Takayuki Kawakami, Matsumoto (JP); Eiji Kumai, Matsumoto (JP); Shuichiro Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/849,730

(22) Filed: Mar. 25, 2013

(65) Prior Publication Data

US 2013/0265364 A1 Oct. 10, 2013

(30) Foreign Application Priority Data

Apr. 5, 2012 (JP) ..... 2012-086205

(51) Int. Cl.
*B41J 2/165* (2006.01)

(52) U.S. Cl.
CPC ..... *B41J 2/16505* (2013.01)
USPC ..... 347/29; 347/30; 347/32

(58) Field of Classification Search
USPC ..... 347/22, 29–34, 36
See application file for complete search history.

(56) References Cited

U.S. PATENT DOCUMENTS 7,159,963 B2 * 1/2007 Nishino ..... 347/33

FOREIGN PATENT DOCUMENTS

JP 2009-292030 12/2009
JP 2010-023453 2/2010

* cited by examiner

*Primary Examiner* — Juanita D Jackson
(74) *Attorney, Agent, or Firm* — Workman Nydegger

(57) ABSTRACT

A liquid removing device which removes liquid attached to an abutment section in a cap having the abutment section which is capable of abutting a liquid ejecting head having a nozzle ejecting the liquid onto a target, includes a transfer section which abuts the abutment section to transfer the liquid attached to the abutment section of the cap, wherein a contact angle between a surface of the transfer section and the liquid is smaller than a contact angle between a surface of the abutment section of the cap and the liquid.

14 Claims, 7 Drawing Sheets

LIQUID REMOVING DEVICE AND LIQUID EJECTING APPARATUS

BACKGROUND

The entire disclosure of Japanese Patent Application No. 2012-086205, filed Apr. 5, 2012, is expressly incorporated by reference herein.

1. Technical Field

The present invention relates to a liquid removing device which removes liquid attached to a cap and a liquid ejecting apparatus including the liquid removing device.

2. Related Art

In the related art, as a type of a liquid ejecting apparatus which ejects liquid from a liquid ejecting head onto a target, an ink jet type printer is widely known. Usually, the printer is capable of performing a cleaning operation which forcedly sucks and discharges the ink from a nozzle of a liquid ejecting head to the inside of a cap, in a state where the cap abuts the nozzle forming surface so as to surround the nozzle of the liquid ejecting head.

However, when the printer performs the cleaning operation, a portion of the ink filled inside the cap attaches to a lip section abutting the nozzle forming surface of the liquid ejecting head in the cap. As a result, after that, the lip section of the cap may not airtightly come into contact with the nozzle forming surface of the liquid ejecting head. In addition, in the recent years, a printer provided with a mechanism for removing the ink attached to the lip section of the cap has been proposed.

For example, in the printer disclosed in JP-A-2010-23453, first, a carriage is moved so that a liquid ejecting head mounted on the carriage crosses an upper side of s wiper member. Then, the ink attached to the nozzle forming surface of the liquid ejecting head when the cleaning operation is performed is removed by wiping operation of the wiper member. After that, the cap is raised and the lip section of the cap abuts the nozzle forming surface of the liquid ejecting head by driving a lifting-lowering unit which lifts and lowers the cap in a direction approaching and separating from the nozzle forming surface of the liquid ejecting head. As a result, the ink attached to the lip section of the cap is removed by being transferred to the nozzle forming surface of the liquid ejecting head.

However, generally, in order to wipe and remove easily the ink attached to the nozzle forming surface of the liquid ejecting head, a water-repellent treatment is subjected to the nozzle forming surface of the liquid ejecting head. In this case, in the printer described above, there is a problem that the ink cannot be efficiently transferred from the lip section of the cap to the nozzle forming surface of the liquid ejecting head having low affinity for the ink.

SUMMARY

An advantage of some aspects of the invention is to provide a liquid removing device which can efficiently remove liquid attached to a cap and a liquid ejecting apparatus.

According to an aspect of the invention, there is provided a liquid removing device which removes liquid attached to an abutment section in a cap having the abutment section which is capable of abutting a nozzle forming surface with respect to a liquid ejecting head having a nozzle ejecting the liquid onto a target, including a transfer section which abuts the abutment section to transfer the liquid attached to the abutment section of the cap, wherein a contact angle between a surface of the transfer section and the liquid is smaller than a contact angle between a surface of the abutment section of the cap and the liquid.

In this case, wettability to the liquid in the transfer section is higher than the wettability to the liquid in the abutment section of the cap. Thus, the liquid attached to the abutment section of the cap is smoothly transferred to the transfer section and can be efficiently removed.

In the liquid removing device, the liquid removing device may further include a recovery member which abuts the transfer section to recover the liquid transferred to the transfer section.

In this case, it can be suppressed that the liquid transferred to the transfer section is dropped from the transfer section due to the gravity.

In the liquid removing device, a contact angle between a surface of the recovering member and the liquid may be smaller than the contact angle between the surface of the transfer section and the liquid.

In this case, the wettability to the liquid in the recovery member is higher than the wettability to the ink in the transfer section. Thus, the liquid transferred to the transfer section can be efficiently recovered with respect to the recovery member.

In the liquid removing device, the transfer section may be integrally movable with a carriage which moves in a state where the liquid ejecting head is mounted, and the recovery member may be disposed on one side of the carriage in a moving direction thereof and the transfer section may be disposed on the other side of the carriage in the moving direction thereof, in a state where the carriage is disposed so that the liquid ejecting head faces the cap.

In this case, after the cleaning operation is performed, in which the abutment section of the cap abuts the nozzle forming surface of the liquid ejecting head to absorb and discharge the liquid from the nozzle, the carriage is moved to the one side in the moving direction. As a result, the transferring operation in which the transfer section abuts the abutment section of the cap to transfer the liquid attached to the abutment section of the cap and the recovering operation in which the recovery member abuts the transfer section to recover the liquid transferred to the transfer section can be sequentially performed.

In the liquid removing device, a distance between the transfer section and the liquid ejecting head in the moving direction of the carriage may be greater than a distance between the cap and the recovery member in the same direction, in a state where the carriage is disposed so that the liquid ejecting head faces the cap.

In this case, after the cleaning operation is performed, in which the abutment section of the cap abuts the nozzle forming surface of the liquid ejecting head to absorb and discharge the liquid from the nozzle, the carriage is moved to the one side in the moving direction. Then, the recovery member abuts the nozzle forming surface of the liquid ejecting head to remove immediately the liquid attached to the nozzle forming surface, at the point before the transfer section abuts the abutment section of the cap to transfer the liquid attached to the abutment section of the cap. Thus it can be suppressed that the liquid attached to the nozzle forming surface of the liquid ejecting head according to the cleaning operation is dropped due to the gravity.

In the liquid removing device, the recovery member may have absorbability and the transfer section do not have absorbability.

In this case, the transfer member does not have absorbability and the recovery member abutting the transfer member has absorbability. Thus, the liquid attached to the transfer member is easily recovered by the recovery member. In addition, it can be suppressed that the liquid is dripped, the target such as the paper is attached to the transfer member or the target is dirty compared to a case where the transfer member has the absorbability.

In addition, according to another aspect of the invention, there is provided a liquid ejecting apparatus including: a liquid ejecting head having a nozzle which ejects liquid; a cap having an abutment section capable of abutting a nozzle forming surface of the liquid ejecting head; and the liquid removing device which removes the liquid from the abutment section of the cap.

In this case, the same effects as those of the liquid removing device of the invention are described above can be obtained.

BRIEF DESCRIPTION OF THE DRAWINGS

The invention will be described with reference to the accompanying drawings, wherein like numbers reference like elements.

FIG. 3A is a schematic view illustrating a state where a cleaning operation of a recording head is carried out, FIG. 3B is a schematic view illustrating a state where the cap is separated from the nozzle forming surface of the recording head in the state of being illustrated in FIG. 3A, FIG. 3C is a schematic view illustrating a state where an absorber abuts the nozzle forming surface of the recording head by moving a carriage in a state of being illustrated in FIG. 3B, and FIG. 3D is a schematic view illustrating a state where the cap is disposed to face a transfer section by moving the carriage in the state being illustrated in FIG. 3C.

FIG. 4A is a schematic view illustrating a state where the cap abuts the transfer section in a state of being illustrated in FIG. 3D, FIG. 4B is a schematic view illustrating a state where the cap is separated from the transfer section in a state of being illustrated in FIG. 4A, FIG. 4C is a schematic view illustrating a state where the absorber abuts the transfer section by moving the carriage in the state being illustrated in FIG. 4B, and FIG. 4D is a schematic view illustrating a state where the absorber is separated from the transfer section by moving the carriage in the state being illustrated in FIG. 4C.

FIG. 9A is a schematic view illustrating a state where the caps on both sides are separated from the transfer section, FIG. 9B is a schematic view illustrating a state where the cap of one side abuts the transfer section, and FIG. 9C is a schematic view illustrating a state where the cap of the other side abuts the transfer section.

DESCRIPTION OF EXEMPLARY EMBODIMENTS

First Embodiment

Hereinafter, a first embodiment which embodies the invention on an ink jet type printer will be described with reference to the drawings.

Figure 1:
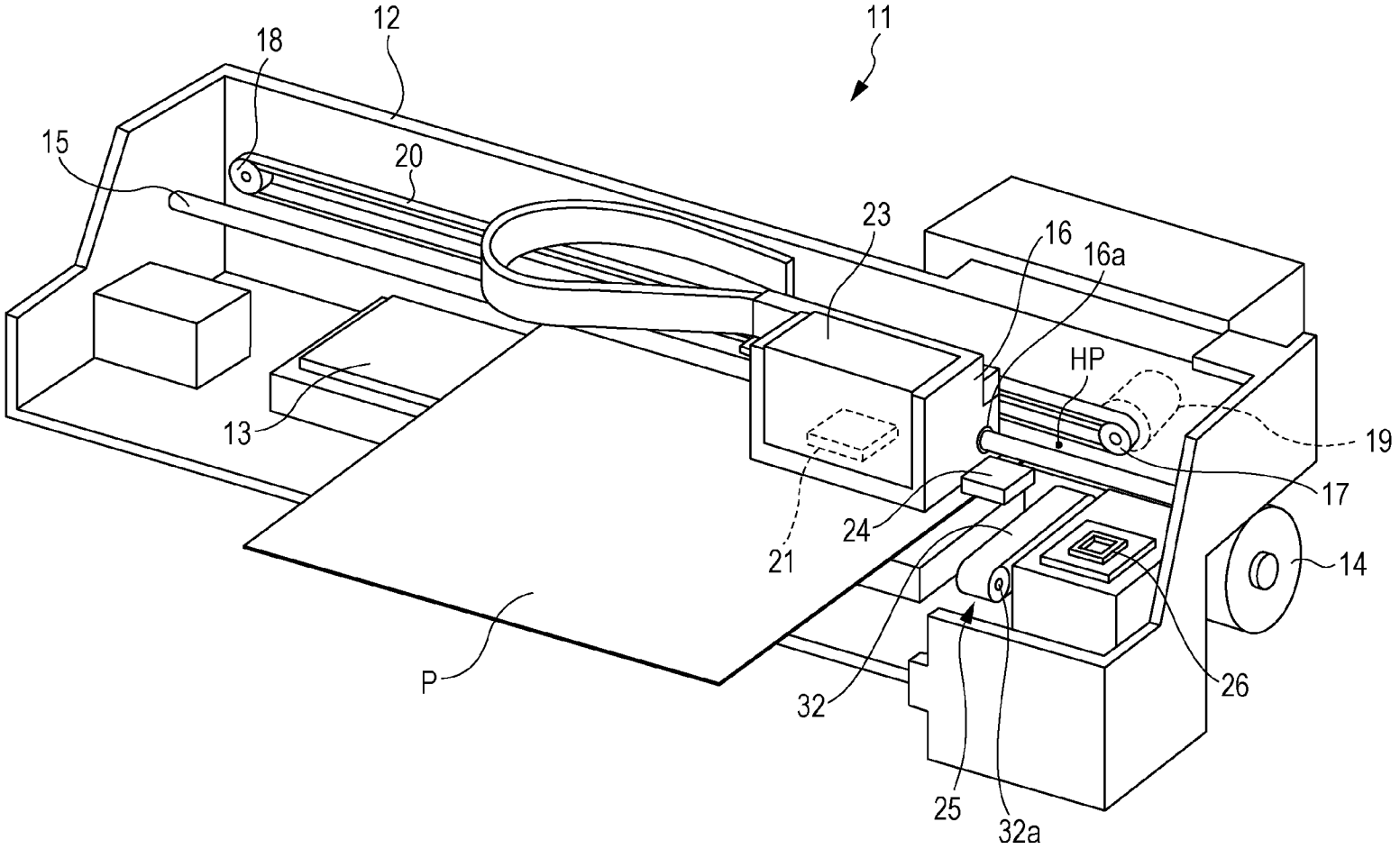
FIG. 1 is a perspective view of a printer of a first embodiment according to the invention.

As illustrated in FIG. 1, in a printer 11 as a liquid ejecting apparatus, a support member 13 supporting a paper P as a target along the longitudinal direction thereof when printing is performed is extended in a lower portion inside a frame 12 having a substantially rectangular-box shape. Then, the paper P is fed by a paper feeding roller 14 provided on the lower portion of a rear surface of the frame 12 in the support member 13.

A guide shaft 15 is bridged on the upper side of the support member 13 inside the frame 12 along a longitudinal direction of the support member 13. The guide shaft 15 supports a carriage 16 capable of reciprocating along an axial direction thereof. In other words, the carriage 16 has a support hole 16*a* through which the guide shaft 15 passes in the axial direction. The guide shaft 15 passes through the support hole 16*a* so that the carriage 16 is reciprocally supported in the axial direction of the guide shaft 15.

A driving pulley 17 and a driven pulley 18 are rotatably supported on a position corresponding to both end portions of the guide shaft 15 inside a wall portion of the rear surface side of the frame 12. An output shaft of a carriage motor 19, which is a driving source when the carriage 16 is reciprocated, is connected to the driving pulley 17. In addition, an endless timing belt 20, a portion of which is connected to the carriage 16 is hung between a pair of pulleys 17 and 18. Accordingly, the carriage 16 is moved in the axial direction of the guide shaft 15 via the endless timing belt 20 by the driving force of the carriage motor 19 while being guided by the guide shaft 15.

A recording head 21 as the liquid ejecting head is provided on the lower surface side of the carriage 16. A plurality of nozzles 22 ejecting the ink as the liquid are open on a nozzle forming surface 21*a* (see, FIG. 2) which is the lower surface of the recording head 21. Meanwhile, an ink cartridge 23 is detachably installed on the carriage 16 to supply the ink with respect to the recording head 21.

The ink inside the ink cartridge 23 is supplied from the ink cartridge 23 to the recording head 21 according to the driving of a piezoelectric element (not illustrated) included in the recording head 21. Thus, the supplied ink is ejected onto the paper P, which is fed on the support member 13, from each of the nozzles 22 of the recording head 21 and then the printing is performed.

In addition, a position which is not corresponding to the paper P inside the frame 12 is a home position HP in which the carriage 16 stands by when the printing is not performed. Then, a transfer section 24, which is integrally moved with the carriage 16 when the printing is performed, is extended on the carriage 16 to the side surface to the home position HP side. The transfer section 24 is constituted of polyoxymethylene (POM) as an example of a non-ink absorbent material having a relatively high wettability to the ink ejected from each of nozzles 22 of the recording head 21. Then, the lower end surface of the transfer section 24 is positioned on substantially the same height as the nozzle forming surface 21*a* of the recording head 21. In addition, as a material of the transfer section 24, any material can be employed as long as the material has relatively high wettability to the ink and, for example, polyethylene terephthalate (PET) or polystyrene (PS) may be employed. In addition, a maintenance device 25 is provided on a position which is a lower side of the home position HP of the carriage to perform the maintenance such as cleaning of the recording head 21 when the printing is not performed.

Next, the maintenance device 25 is described.

Figure 2:
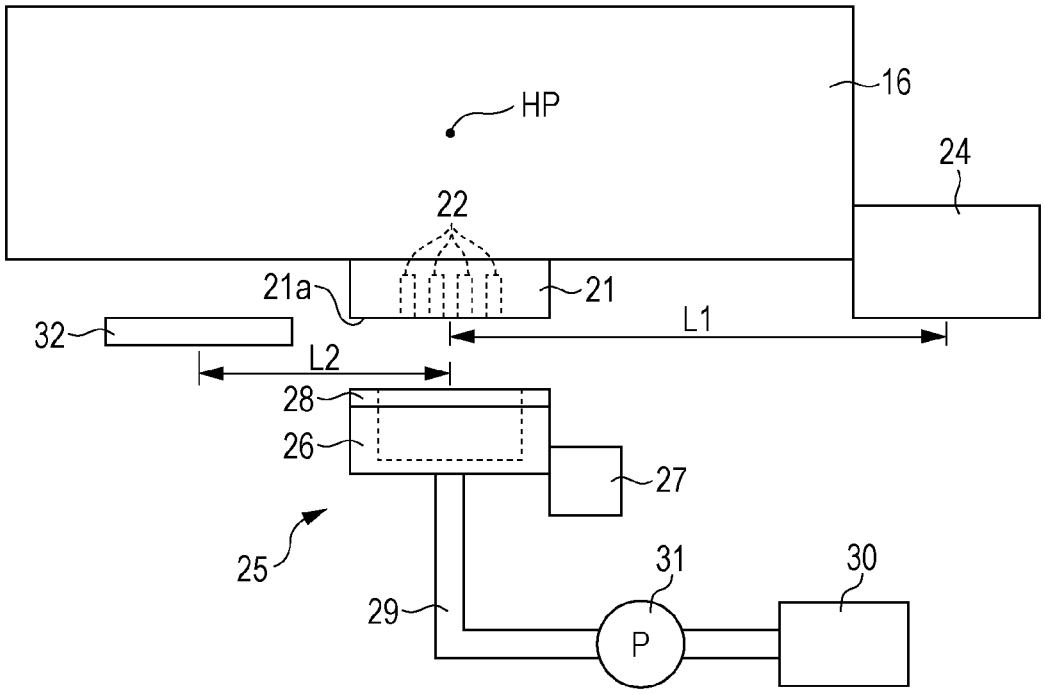
FIG. 2 is a schematic constitution view of a maintenance device in the printer of the same embodiment.

As illustrated in FIG. 2, a cap 26 has a substantially rectangular-box shape bottom and is open on the upper side thereof. The cap 26 moves between an abutting position in which the cap 26 abuts the nozzle forming surface 21*a* of the recording head 21 and a retracted position in which the cap 26 separates from the nozzle forming surface 21*a* of the recording head 21, based on the driving of a lifting mechanism 27. In this case, when the cap 26 is positioned on the abutting position, a sealed space region is formed between the cap 26 and the nozzle forming surface 21*a* of the recording head 21. In addition, the cap 26 has a seal section 28 as an abutment section which is circular along an opening edge of the cap 26 and protrudes upward. The seal section 28 is constituted of an elastomer such as rubber shrinkable in the vertical direction in a state of coming pressed contact with the nozzle forming surface 21*a* of the recording head 21.

In addition, one end side of a discharge tube 29 formed from a flexible material such as silicon rubber is connected to the lower surface side of the cap 26 to communicate with the inside of the cap 26. In addition, the other end side of the discharge tube 29 is inserted inside a waste-ink tank 30 disposed on the lower position inside the frame 12. In addition, a pump 31, which is driven in a state where the ink is flowed from the cap 26 side to the waste-ink tank 30 side, is provided on an intermediate portion between the cap 26 and the waste-ink tank 30 in the longitudinal direction of the discharge tube 29.

In addition, as illustrated in FIGS. 1 and 2, an absorber 32 is provided between the support member 13 and the cap 26 in the moving direction of the carriage 16 as a recovery member absorbing and recovering the ink from the nozzle forming surface 21*a* of the recording head 21. In other words, in a state where the carriage 16 is disposed so that the recording head 21 faces the cap 26, the absorber 32 is disposed on one side of the carriage 16 in the moving direction and the transfer section 24 is disposed on the other side of the carriage 16 in the moving direction. The absorber 32 is constituted of a long nonwoven fabric made of pulp fiber. In addition, the absorber 32 is hung between a pair of rollers (only the roller 32*a* of one side is illustrated in FIG. 1) disposed having a distance in the horizontal direction orthogonal to the moving direction of the carriage 16. The roller of one side in a pair of the rollers feeds the unused absorber 32 wound around and the roller of the other side winds the absorber 32 which is used for wiping. In addition, a distance L1 between the transfer section 24 and the recording head 21 in the moving direction of the carriage 16 is set to be longer than a distance L2 between the cap 26 and the absorber 32 in the same direction.

In addition, since the pair of the rollers on which the absorber 32 is hung is positioned on the substantially same height as each other, the absorber 32 is fed from the roller of one side in the horizontal direction orthogonal to the moving direction of the carriage 16. More specifically, top portion of each peripheral surface of the pair of the rollers is positioned on the substantially same height as the nozzle forming surface 21*a* of the recording head 21. Thus, in a case where the carriage 16 moves to cross the upper portion of the absorber 32, the nozzle forming surface 21*a* of the recording head 21 mounted on the carriage 16 abuts the absorber 32.

In this case, a length dimension of a portion of the absorber 32 which is hung between the pair of the rollers is greater than a width dimension of the nozzle forming surface 21*a* of the recording head 21 in a direction orthogonal to the moving direction of the carriage 16. Thus, when the carriage 16 moves, an entire region of the nozzle forming surface 21*a* of the recording head 21 abuts the absorber 32.

In addition, the top portion of each peripheral surface of the pair of the rollers is positioned on the substantially same height as the lower end surface of the transfer section 24. Thus, when the carriage 16 moves to cross the upper portion of the absorber 32, the lower end surface of the transfer section 24 abuts the absorber 32.

Next, action of the printer 11 constituted as described above, is described.

Figure 3A:
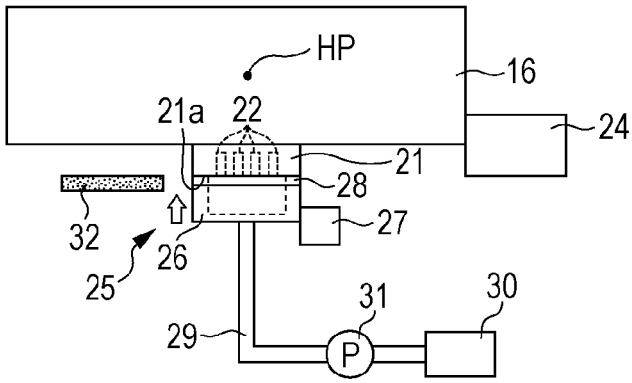
FIGS. 3A to 3D are schematic views illustrating action when the ink attached to the cap is removed.

Now, in the embodiment, as illustrated in FIG. 3A, when maintenance operation of the recording head 21 is performed, the cap 26 is raised due to the driving of the lifting mechanism 27, after the carriage 16 is stood by on the home position HP. Then, the cap 26 abuts the nozzle forming surface 21*a* of the recording head 21 to surround each of the nozzles 22. In other words, a sealed space region is formed between the nozzle forming surface 21*a* of the recording head 21 and the cap 26. Thus, in this state, when the pump 31 is driven, the ink thickened from each of the nozzles 22 is discharged inside the cap 26 with air bubbles or the like, based on a negative pressure generated inside the cap 26. As a result, the ink fills the sealed space region inside the cap 26.

Figure 3B:
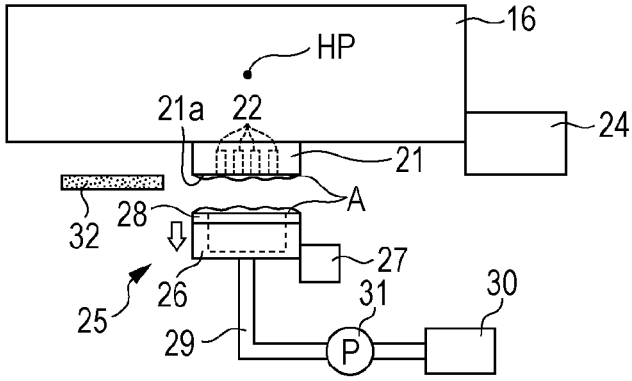

Next, as illustrated in FIG. 3B, the cap 26 is moved downward by driving the lifting mechanism 27 and then the cap 26 is separated from the nozzle forming surface 21*a* of the recording head 21. Then, the ink remained inside the cap 26 is idly absorbed by the pump 31 and then is discharged to the waste-ink tank 30 through the discharge tube 29. In this case, the ink A filled inside the cap 26 is attached to the seal section 28 of the cap 26 and the nozzle forming surface 21*a* of the recording head 21.

Figure 3C:
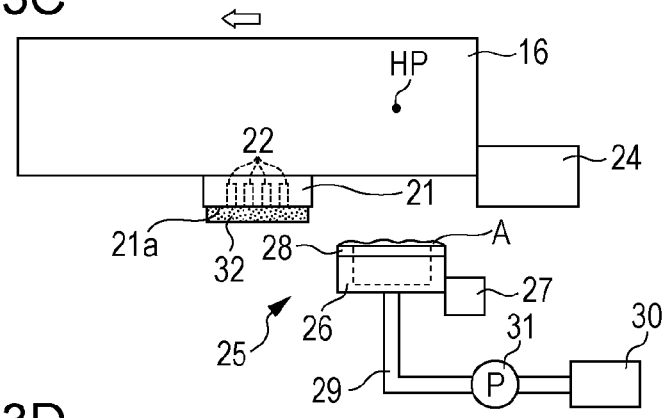

Subsequently, as illustrated in FIG. 3C, the carriage 16 is moved along the guide shaft 15 in a direction away from the home position HP. Then, the recording head 21 mounted on the carriage 16 crosses the upper surface of the absorber 32 in the moving direction of the carriage 16. As a result, the ink A attached to the nozzle forming surface 21*a* of the recording head 21 is absorbed and recovered by the absorber 32.

Figure 3D:
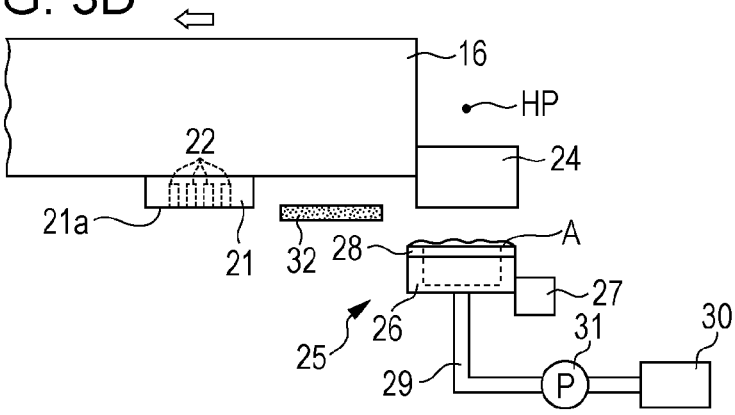

Next, as illustrated in FIG. 3D, the carriage 16 is moved along the guide shaft 15 further in a direction away from the home position HP. Then, the movement of the carriage 16 is stopped at a position in which the cap 26 faces the transfer section 24 extended from the carriage 16 in the vertical direction.

Figure 4A:
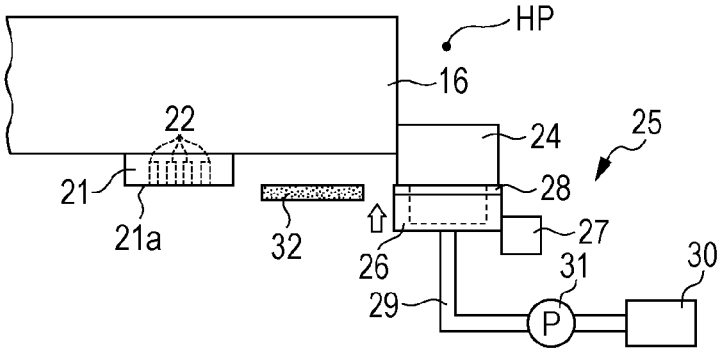
FIGS. 4A to 4D are schematic views illustrating action when the ink attached to the cap is removed.

Subsequently, in this state, as illustrated in FIG. 4A, the cap 26 is raised by driving the lifting mechanism 27. Then, the seal section 28 of the cap 26 abuts the lower end surface of the transfer section 24. As a result, the ink A attached to the seal section 28 of the cap 26 comes into contact with the transfer section 24.

Figure 4B:
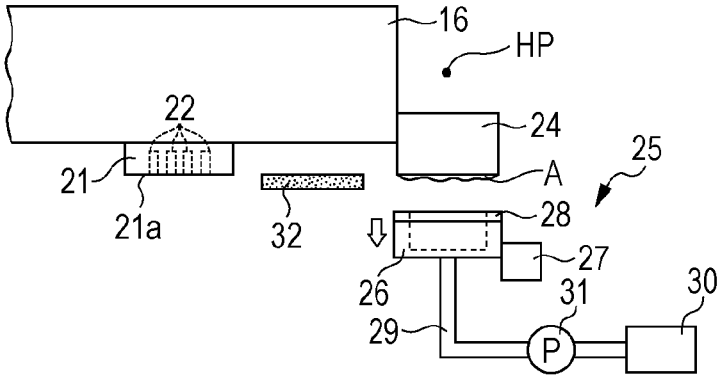
Figure 5:
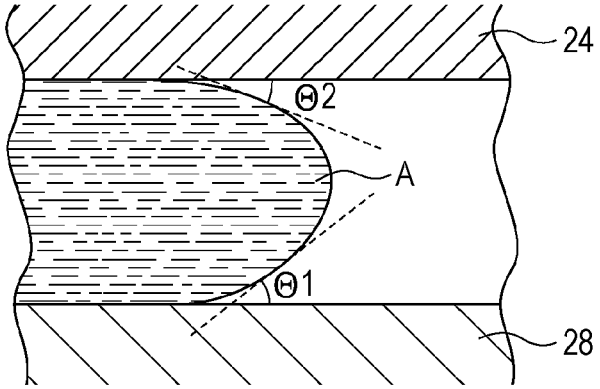
FIG. 5 is a schematic view illustrating a state where the ink attached to the cap comes into contact with the transfer section.

In this case, as illustrated in FIG. 5, in the embodiment, the transfer section 24 has the wettability to the ink A higher than the seal section 28. Thus, a contact angle Θ2 to the ink A in the transfer section 24 is smaller than a contact angle Θ1 to the ink A in the seal section 28. As a result, as illustrated in FIG. 4B, in this state, when the cap 26 is separated from the transfer section 24 by moving the cap 26 downward by driving the lifting mechanism 27, the ink A attached to the seal section 28 is transferred to the lower end surface of the transfer section 24.

Figure 4C:
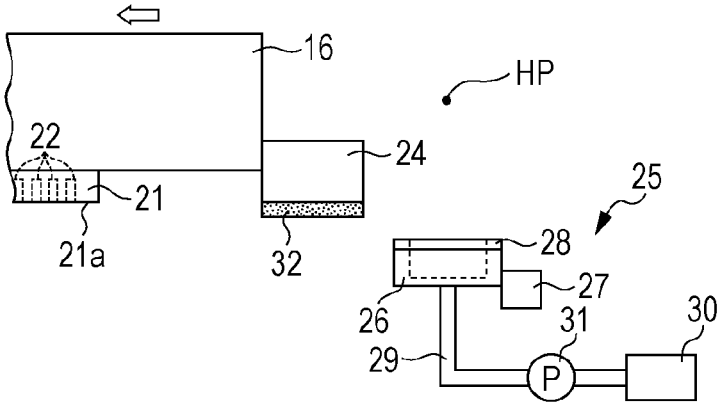

Next, as illustrated in FIG. 4C, the carriage 16 is moved along the guide shaft 15 further in the direction away from the home position HP. Then, the transfer section 24 extended from the carriage 16 crosses the upper surface of the absorber 32 in the moving direction of the carriage 16. As a result, the ink A attached to the lower end surface of the transfer section 24 comes into contact with the absorber 32.

Figure 4D:
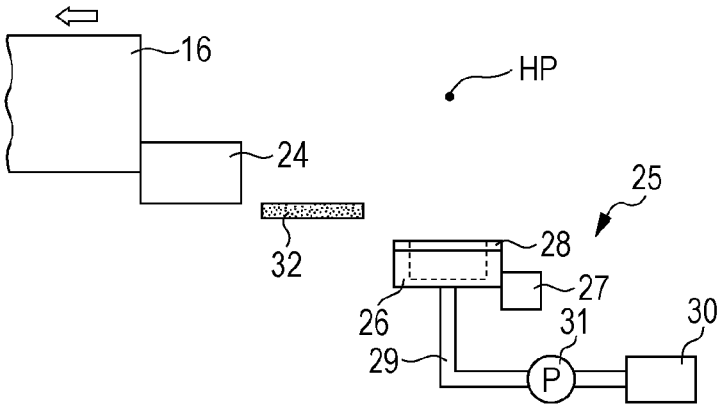
Figure 6:
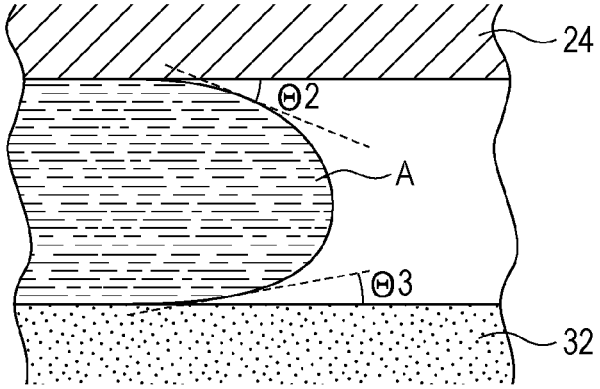
FIG. 6 is a schematic view illustrating a state where the ink transferred to the transfer section comes into contact with the absorber.

In this case, as illustrated in FIG. 6, in the embodiment, the absorber 32 has the wettability to the ink A higher than that of the transfer section 24. Thus, a contact angle Θ3 to the ink A in the absorber 32 is greater than the contact angle Θ2 to the ink A in the transfer section 24. As a result, as illustrated in FIG. 4D, when the carriage 16 is moved along the guide shaft 15 further in the direction away from the home position HP and the transfer section 24 is separated from the absorber 32, the ink A transferred to the transfer section 24 is absorbed and recovered by the absorber 32.

In other words, in the embodiment, after the ink attached to the seal section 28 of the cap 26 is once transferred to the transfer section 24, the ink is recovered from the transfer section 24 to the absorber 32. In this regard, in the embodiment, the liquid removing device is constituted in which the ink attached to the seal section 28 of the cap 26 is removed by the transfer section 24 and the absorber 32.

According to the first embodiment described above, following effects can be obtained.

(1) The wettability to the ink in the transfer section 24 is higher than the wettability to the ink in the seal section 28 of the cap 26. Thus, the ink attached to the seal section 28 of the cap 26 is smoothly transferred to the transfer section 24 and can be efficiently removed.

(2) The absorber 32 recovers the ink transferred to the transfer section 24. Accordingly, it can be suppressed that the ink transferred to the transfer section 24 is dropped from the transfer section 24 due to the gravity.

(3) The wettability to the ink in the absorber 32 is higher than the wettability to the ink in the transfer section 24. Thus, the ink transferred to the transfer section 24 can be efficiently recovered with respect to the absorber 32.

(4) After the cleaning operation is performed, in which the seal section 28 of the cap 26 abuts the nozzle forming surface 21*a* of the recording head 21 and then to absorb and discharge the ink from the nozzle 22, the carriage 16 is moved to the one side in the moving direction. As a result, the transferring operation in which the transfer section 24 abuts the seal section 28 of the cap 26 to transfer the ink attached to the seal section 28 of the cap 26 and the recovering operation in which the absorber 32 abuts the transfer section 24 to recover the ink transferred to the transfer section 24 are can be sequentially performed.

(5) After the cleaning operation is performed, in which the seal section 28 of the cap 26 abuts the nozzle forming surface 21*a* of the recording head 21 to absorb and discharge the ink from the nozzles 22, the carriage 16 is moved to the one side in the moving direction. Then, the absorber 32 abuts the nozzle forming surface 21*a* of the recording head 21, at the point before when the transfer section 24 abuts the seal section 28 of the cap 26 to transfer the ink attached to the seal section 28 of the cap 26. As a result, since the ink attached to the nozzle forming surface 21*a* is removed immediately, the ink attached to the nozzle forming surface 21*a* of the recording head 21 according to the cleaning operation is dropped due to the gravity.

Second Embodiment

Next, a second embodiment of the invention will be described, based on FIGS. 7 to 9C. In addition, the second embodiment is different from the first embodiment in that two recording heads 21A and 21B are provided on the carriage 16. Accordingly, in the following description, configurations different from the first embodiment are mainly described and the same reference numeral will be given to the same or corresponding constitution in the first embodiment, and repeated description thereof will be omitted.

Figure 7:
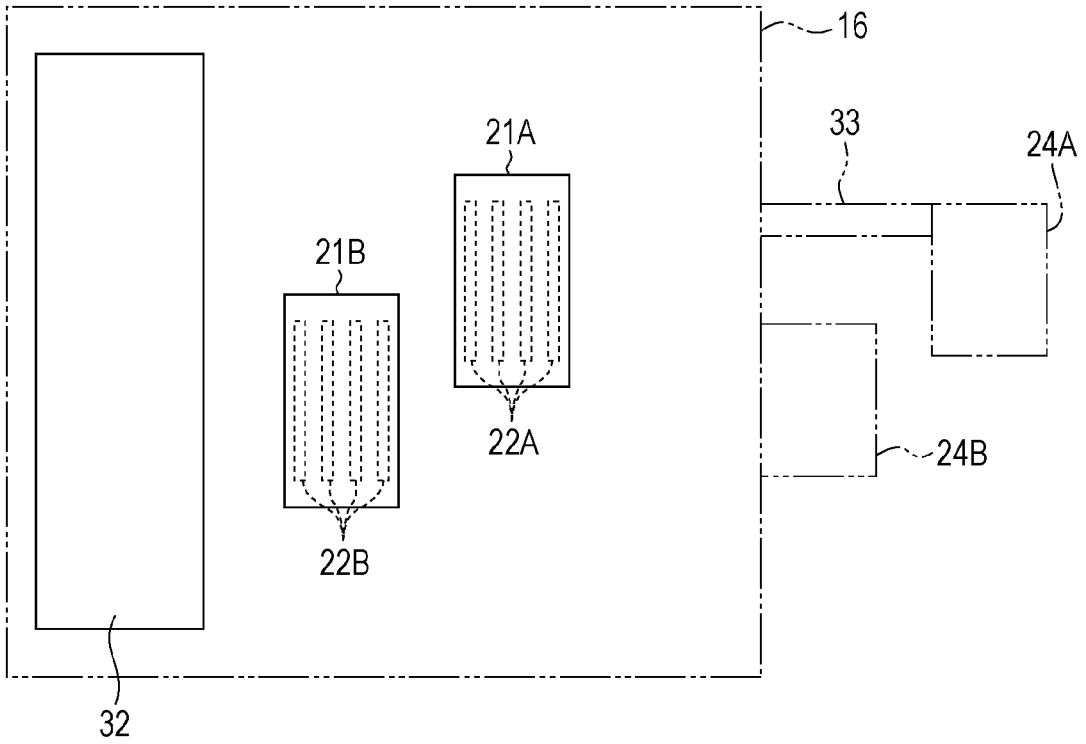
FIG. 7 is a schematic plan view illustrating a surrounding structure of the carriage in the printer of a second embodiment according to the invention.

Now, as illustrated in FIG. 7, two recording heads 21A and 21B are provided on the lower surface side of the carriage 16 so that nozzle opening rows 22A and 22B are partially overlapped in a direction orthogonal to the moving direction of the carriage 16. In addition, transfer sections 24A and 24B are positioned, respectively, on position corresponding to each of recording heads 21A and 21B in the moving direction of the carriage 16. In addition, the transfer sections 24A and 24B are positioned on the side wall portion toward the home position HP side in the carriage 16 when the printing is performed. Then, both transfer sections 24A and 24B have width dimensions across extending throughout the entire region of the nozzle opening rows 22A and 22B of the recording heads 21A and 21B respectively, in the direction orthogonal to the moving direction of the carriage 16. In addition, the transfer section 24A (the transfer section positioned on the right side insulating film 7) of one side in both transfer sections 24A and 24B is connected to the carriage 16 via a connection section 33 of which a width dimension is smaller than that of the transfer section 24A in the direction orthogonal to the moving direction of the carriage 16. Then, an interval is formed between the connection section 33 and the transfer section 24B in the direction orthogonal to the moving direction of the carriage 16.

Figure 8:
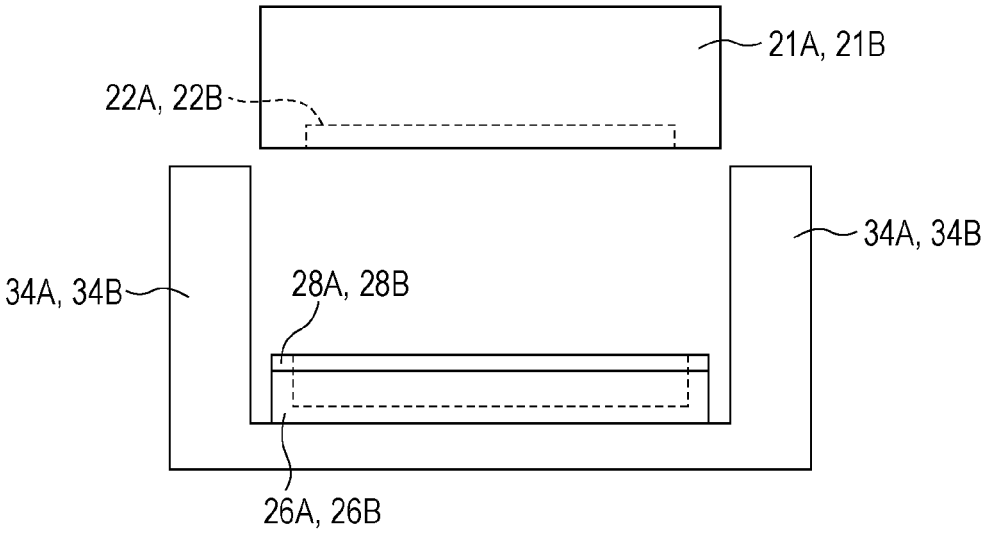
FIG. 8 is a schematic view of the recording head and the cap in the printer of the same embodiment.
Figure 9A:
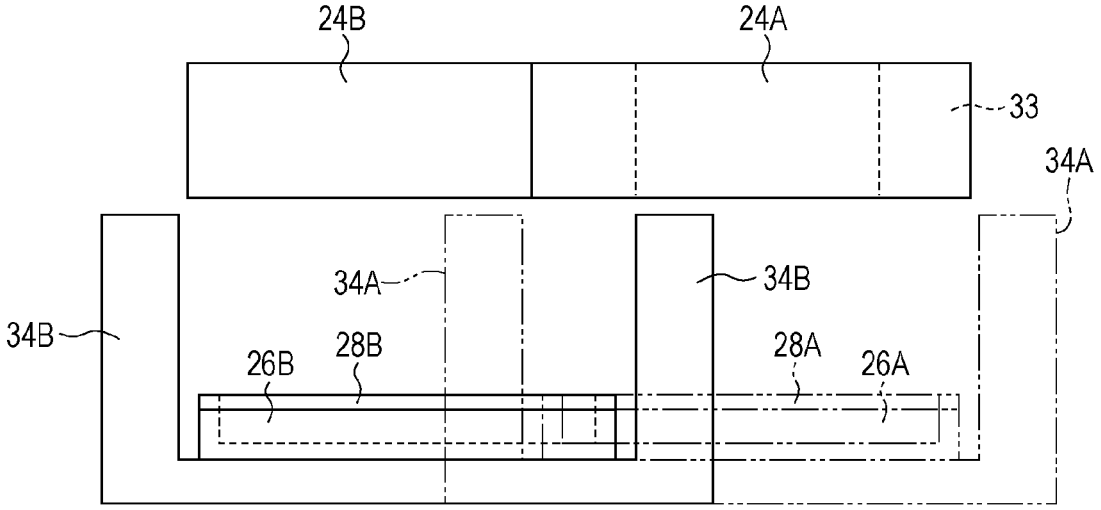
FIGS. 9A to 9C are schematic views illustrating the transfer section and the cap in the printer of the same embodiment.

In addition, as illustrated in FIG. 8, caps 26A and 26B are provided corresponding to both transfer sections 24A and 24B individually and are provided to protrude upward from an inner bottom surface of head guides 34A and 34B having a substantially U shape in a side view. Wall portions of both sides of the head guides 34A and 34B in the longitudinal direction are disposed with an interval which is substantially the same as the dimension of the recording heads 21A and 21B in the longitudinal direction of the recording heads 21A and 21B. Then, when the head guides 34A and 34B rise in a direction approaching to the recording heads 21A and 21B according to the driving of the lifting mechanism 27, the recording heads 21A and 21B enter between the both wall portions of the head guides 34A and 34B, and the caps 26A and 26B are positioned with respect to the recording heads 21A and 21B. In addition, as illustrated in FIG. 9A, the caps 26A and 26B are provided on positions which are different from each other in the moving direction of the carriage 16 so that the caps 26A and 26B are partially overlapped in the direction orthogonal to the moving direction of the carriage 16.

Figure 9B:
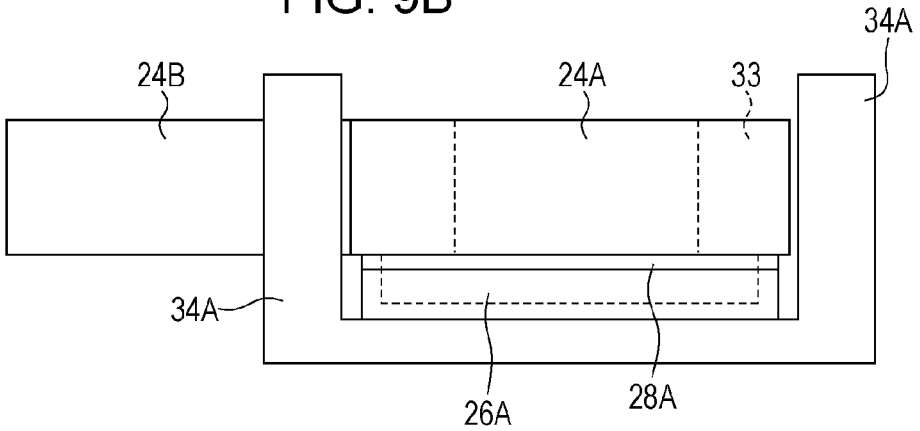

Then, as illustrated in FIG. 9B, one cap 26A in both caps 26A and 26B rises according to the driving of the lifting mechanism 27, the head guide 34A, in which the cap 26A is provided, and passes through outside of both ends the transfer section 24A in the longitudinal direction and a seal section 28A of the cap 26A abuts the transfer section 24A.

Figure 9C:
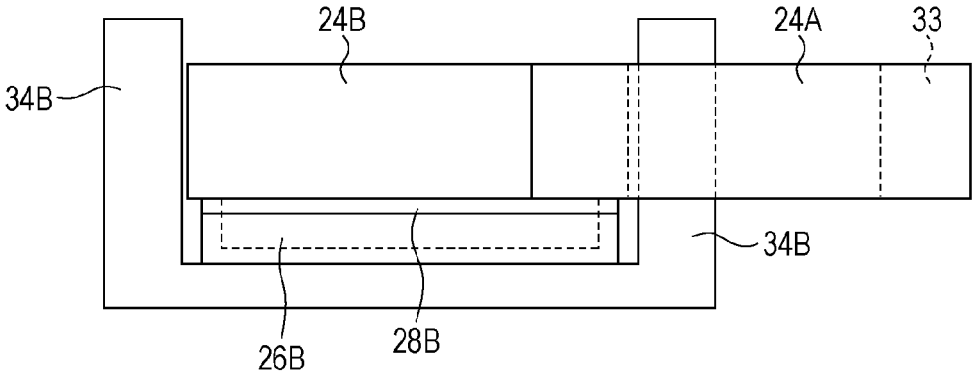

In addition, as illustrated in FIG. 9C, when the other side cap 26B in both caps 26A and 26B rises according to the driving of the lifting mechanism 27, the head guide 34B, in which the cap 26B is provided, passes through outside of one end of the transfer section 24B in the longitudinal direction and an interval between the connection section 33 and the transfer section 24B. Thus, the lifting of the head guide 34B is not blocked by the transfer section 24A and the sealing section 28B of the cap 26B abuts the transfer section 24B.

According to the second embodiment described above, the same effects as the effects (1) to (5) of the first embodiment are obtained.

In addition, each of the embodiments described above may be changed to other embodiments described below.

In each of the embodiments described above, the distance L1 between the transfer section 24 and the recording head 21 in the moving direction of the carriage 16 may be set to be substantially the same as the distance L2 between the cap 26 and the absorber 32 in the same direction.

In this constitution, after the cleaning operation is performed in which the seal section 28 of the cap 26 abuts the nozzle forming surface 21*a* of the recording head 21, 21A and 21B, the ink from the nozzles 22 is sucked and discharged, and the carriage 16 is moved on one side in the moving direction. Then, the transfer sections 24, 24A and 24B abut the sealing section 28 of the caps 26, 26A and 26B and the ink attached to the seal sections 28, 28A and 28B of the caps 26, 26A and 26B is transferred. In addition, the absorber 32 abuts the nozzle forming surface 21*a* of the recording heads 21, 21A and 21B, and the ink attached to the nozzle forming surface 21*a* is removed. Thus, throughput can be improved when the ink attached to the seal sections 28, 28A and 28B of the caps 26, 26A and 26B is removed.

In addition, the distance L1 between the transfer section 24 and the recording head 21 in the moving direction of the carriage 16 may be smaller than the distance L2 between the cap 26 and the absorber 32 in the same direction.

In each of the embodiments described above, the transfer sections 24, 24A and 24B may be extended on the side wall portion toward opposite side to the home position HP in the carriage 16 when printing is performed. In this case, in a state where the carriage 16 is disposed so that the recording head 21 faces the caps 26, 26A and 26B, the transfer sections 24, 24A and 24B, and the absorber 32 are disposed on the same side in the moving direction of the carriage 16.

In each of the embodiments described above, a constitution may be adapted in which a wiping member is employed as the recovering member which recovers the ink transferred to the transfer sections 24, 24A and 24B, and the wiping member wipes and removes the ink transferred to the transfer sections 24, 24A and 24B. In this case, as a material of the wiping embodiment, a non-ink absorbing material may be employed. However, in order to transfer smoothly the ink transferred to the transfer sections 24, 24A and 24B from the transfer sections 24, 24A and 24B to the wiping member, it is preferable that the wettability to the ink in the wiping member be higher than the wettability to the ink in the transfer sections 24, 24A and 24B.

In each of the embodiments described above, as the transfer section, the nozzle forming surface 21*a* of the recording heads 21, 21A and 21B having the wettability to the ink higher than that of the seal sections 28, 28A and 28B of the caps 26, 26A and 26B may be employed.

In each of the embodiments described above, the liquid ejecting apparatus is embodied as the printer 11 ejecting the ink as the liquid; however, the liquid ejecting apparatus may be embodied as a liquid ejecting apparatus ejecting or discharging liquid other than the ink. The invention may be applied to various types of liquid ejecting apparatuses including a liquid ejecting head or the like ejecting small amount of liquid droplets. In addition, liquid droplets are referred to as a state of the liquid ejected from the liquid ejecting apparatus described above and also includes liquids trailing in granular shape, a tear shape and a thread shape. In addition, the liquid referred to herein may be a material which can be ejected from the liquid ejecting apparatus. For example, a material may be used as long as the material is in the state of the liquid phase. In addition, the material includes liquid material having high or low viscosity, a flow-shape body such as sol, gel water, inorganic solvent, organic solvent, solution, liquid-shaped resin, liquid-shaped metal (melt metal), and not only the liquid as one state of a material but also a material in which particles of functional material consisted of solids such as pigments or metal particles is dissolved, dispersed or mixed in a solvent. In addition, a representative example of the liquid includes the ink described in the above embodiment, liquid crystal or the like. Here, the ink is intended to include various types of liquid compositions such as general water-based ink, oil-based ink, gel ink and hot melt ink. A specific example of the liquid ejecting apparatus includes, for example, a liquid ejecting apparatus ejecting liquid including in a form of dispersed or dissolved material such as color material or electrode material that is used to manufacture a liquid crystal display, an EL (electroluminescence) display, a surface emitting display and color filter. Otherwise, the liquid ejecting apparatus may be a liquid ejecting apparatus ejecting a bioorganic material used for biochip manufacturing, a liquid ejecting apparatus ejecting liquid which is a sample used as a precision pipette, a printing apparatus, a micro-dispenser or the like. Furthermore, the liquid ejecting apparatus may employ a liquid ejecting apparatus ejecting lubricant at pin point to a precision machine such as a watch or a camera, a liquid ejecting apparatus ejecting transparent resin liquid such as an ultraviolet curing resin to form micro hemispherical lens (an optical lens) used for an optical communication device or the like on a substrate, and a liquid ejecting apparatus ejecting etching liquid such as acid or alkali to etch a substrate or the like. Then, the invention may be applied to any one of the liquid ejecting apparatuses.

What is claimed is:

1. A liquid removing device which removes liquid attached to an abutment section in a cap having the abutment section which is capable of abutting a nozzle forming surface with respect to a liquid ejecting head having a nozzle ejecting the liquid onto a target, comprising:

a transfer section which abuts the abutment section to transfer the liquid attached to the abutment section of the cap, and a recovery member which abuts the transfer section to recover the liquid transferred to the transfer section by removing the liquid from the transfer section.

2. The liquid removing device according to claim 1, wherein a contact angle between a surface of the recovering member and the liquid is smaller than the contact angle between the surface of the transfer section and the liquid.

3. The liquid removing device according to claim 1, wherein the transfer section is integrally movable with a carriage which moves in a state where the liquid ejecting head is mounted, and wherein the recovery member is disposed on one side of the carriage in a moving direction thereof and the transfer section is disposed on the other side of the carriage in the moving direction thereof, in a state where the carriage is disposed so that the liquid ejecting head faces the cap.

4. The liquid removing device according to claim 3, wherein a distance between the transfer section and the liquid ejecting head in the moving direction of the carriage is greater than a distance between the cap and the recovery member in the same direction, in a state where the carriage is disposed so that the liquid ejecting head faces the cap.

5. The liquid removing device according to claim 1, wherein the recovery member has absorbability and the transfer section does not have absorbability.

6. A liquid ejecting apparatus comprising:

the liquid ejecting head having the nozzle which ejects liquid;

the cap having the abutment section capable of abutting the nozzle forming surface of the liquid ejecting head; and the liquid removing device according to claim 1 which removes the liquid from the abutment section of the cap.

7. The liquid removing device according to claim 1, wherein a contact angle between a surface of the transfer section and the liquid is smaller than a contact angle between a surface of the abutment section of the cap and the liquid.

8. A liquid ejecting apparatus comprising a liquid ejecting head having a nozzle which ejects liquid, a cap having an abutment section capable of abutting the liquid ejecting head, and a liquid removing device removing the liquid from the abutment section of the cap, the liquid removing device comprising:

a transfer section which abuts the abutment section to transfer the liquid attached to the abutment section of the cap and does not have absorbability, wherein a contact angle between a surface of the transfer section and the liquid is smaller than a contact angle between a surface of the abutment section of the cap and the liquid.

9. The liquid ejecting apparatus according to claim 8, wherein the transfer section is integrally movable with a carriage which moves in a state where the liquid ejecting head is mounted.

10. The liquid ejecting apparatus according to claim 8, wherein the liquid removing device comprises a recovery member which abuts the transfer section to recover the liquid transferred to the transfer section.

11. The liquid ejecting apparatus according to claim 10, wherein the recovery member is disposed on one side of the carriage in a moving direction thereof and the transfer section is disposed on the other side of the carriage in the moving direction thereof, in a state where the carriage is disposed so that the liquid ejecting head faces the cap.

12. The liquid ejecting apparatus according to claim 10, wherein a distance between the transfer section and the liquid ejecting head in the moving direction of the carriage is greater than a distance between the cap and the recovery member in the same direction, in a state where the carriage is disposed so that the liquid ejecting head faces the cap.

13. The liquid ejecting apparatus according to claim 10, wherein a contact angle between a surface of the recovering member and the liquid is smaller than the contact angle between the surface of the transfer section and the liquid.

14. The liquid ejecting apparatus according to claim 10, wherein the recovery member has absorbability.

* * * * *